US006353939B1

(12) United States Patent
Arber

(10) Patent No.: US 6,353,939 B1
(45) Date of Patent: Mar. 12, 2002

(54) DISPOSABLE ONE-TIME USE LEGGING FOR COVERING, AND PROTECTING, A LOWER LEG OF A WEARER FROM, AND CAPTURING, TICKS

(76) Inventor: Janice Arber, 136 Waverly Pl., Apt. 6B, New York, NY (US) 10014

( * ) Notice: Subject to any disclaimer, the term of this patent is extended or adjusted under 35 U.S.C. 154(b) by 0 days.

(21) Appl. No.: 09/728,874

(22) Filed: Dec. 4, 2000

(51) Int. Cl.[7] ..... A41D 17/02
(52) U.S. Cl. ..... 2/242; 2/61
(58) Field of Search ..... 2/61, 22, 231, 2/232, 911; D2/901

(56) References Cited

U.S. PATENT DOCUMENTS

| | | | | | |
|---|---|---|---|---|---|
| 2,429,625 | A | * | 10/1947 | Horn | 2/61 |
| 2,544,065 | A | * | 3/1951 | Carr | 2/22 |
| 3,083,373 | A | * | 4/1963 | Rizzoto | 2/270 |
| 3,191,185 | A | * | 6/1965 | Martin | 2/22 |
| 3,633,290 | A | * | 1/1972 | Rubeling | 36/2 R |
| 3,721,997 | A | * | 3/1973 | Mundt | 2/46 |
| 4,542,597 | A | * | 9/1985 | Bapista et al. | 36/2 R |
| 5,010,597 | A | * | 4/1991 | Glover | 2/242 |
| 5,170,503 | A | * | 12/1992 | Hightower, Jr et al. | 2/22 |
| 5,249,310 | A | * | 10/1993 | Forte | 2/239 |
| 5,381,557 | A | * | 1/1995 | Luria et al. | 2/16 |
| 5,542,121 | A | * | 8/1996 | Lahaussois et al. | 2/59 |
| 5,815,948 | A | * | 10/1998 | Dzielak | 36/2 R |
| 6,047,403 | A | * | 4/2000 | Juozaitis | 2/61 |
| 6,141,802 | A | * | 11/2000 | Drake | 2/227 |
| 6,199,217 | B1 | * | 3/2001 | Mooney | 2/240 |
| 6,205,593 | B1 | * | 3/2001 | Schaub, Jr. | 2/242 |

* cited by examiner

*Primary Examiner*—John J. Calvert
*Assistant Examiner*—Alissa L. Hoey

(57) ABSTRACT

A disposable one-time use legging for covering, and protecting, a lower leg of a wearer from, and capturing, ticks. The legging includes a sleeve, first bands, and a second band. The uppermost terminal end of the sleeve is formed into an upper circumferential tunnel, and the lowermost terminal end of the sleeve is formed into a lower circumferential tunnel. The first bands include an uppermost first band that is elastic and encased in the uppermost circumferential tunnel of the sleeve for maintaining the uppermost terminal end of the sleeve in position tightly and securely around, and in direct snug contact with, the lower leg of the wearer, just below the knee of the wearer so as to prevent the ticks from getting therebetween, an intermediate first band that is elastic and encased in the lowermost circumferential tunnel of the sleeve for maintaining the lowermost terminal end of the sleeve in position tightly and securely around, and in direct snug contact with, the ankle of the wearer so as to prevent the ticks from getting therebetween, and a lowermost first band that is elastic and depends from the lowermost terminal end of the sleeve so as to form a stirrup for receiving the foot of the wearer. The second band includes a strip of adhesive that extends around the sleeve for capturing the ticks attempting to excursion thereon, and a release sheet that releasably covers the strip of adhesive thereof, prior to use.

12 Claims, 1 Drawing Sheet

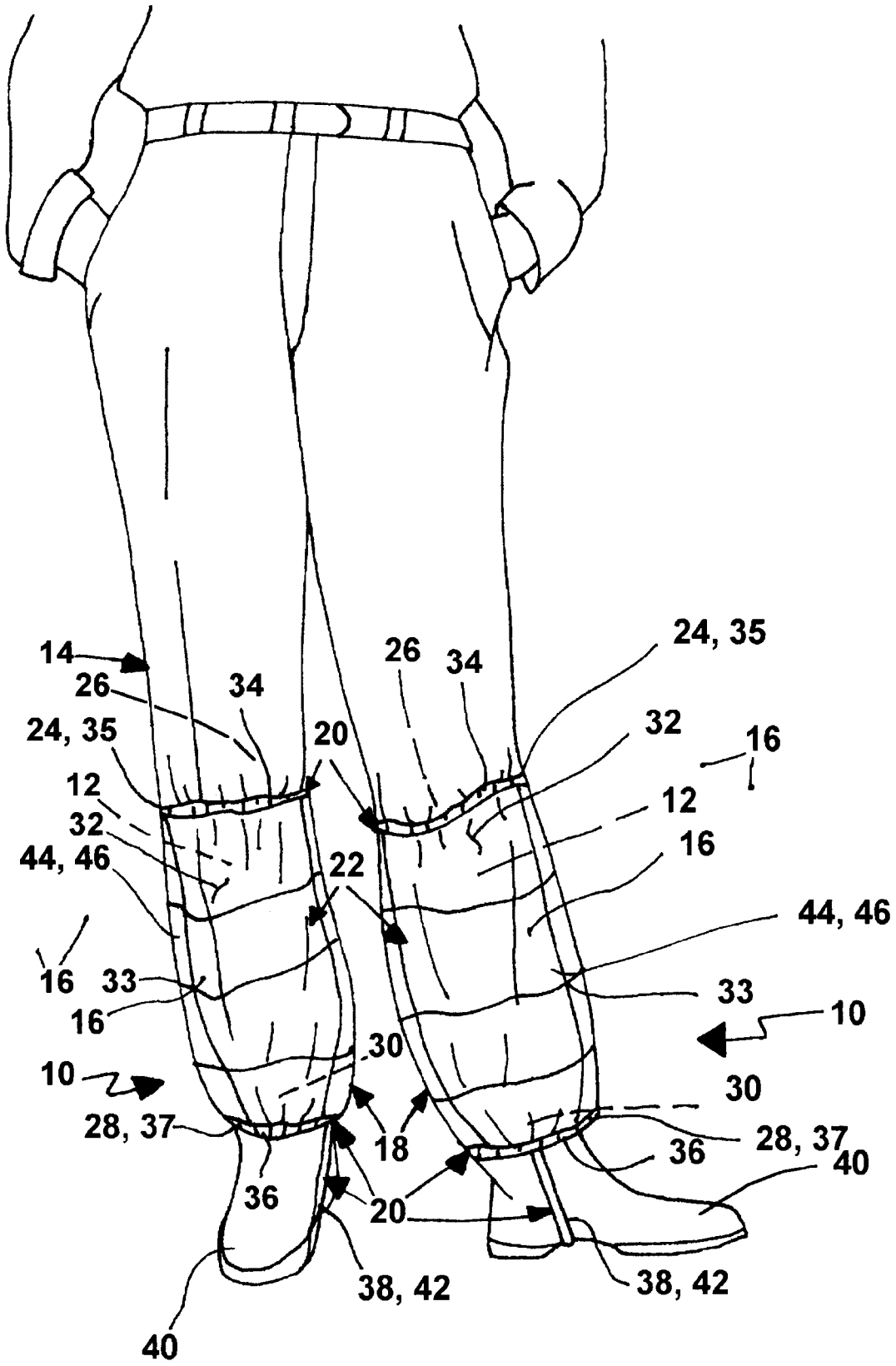
14
26
34
24, 35
20
12
32
44, 46
22
16
33
16
10
28, 37
36
40
38, 42
18
30
26
34
24, 35
32
16
12
16
44, 46
33
10
30
28, 37
36
40
20
38, 42

DISPOSABLE ONE-TIME USE LEGGING FOR COVERING, AND PROTECTING, A LOWER LEG OF A WEARER FROM, AND CAPTURING, TICKS

BACKGROUND OF THE INVENTION

1. Field of the Invention

The present invention relates to a disposable legging. More particularly, the present invention relates to a disposable one-time use legging for covering, and protecting, a lower leg of a wearer from, and capturing, ticks.

2. Description of the Prior Art

Gardening is America's number one leisure activity. Each year record numbers of recreational gardeners venture out into the out of doors. Along with hikers, and all nature lovers, the threat of Lyme disease is ever present. This infectious disease is the result of a bite of a tick carrying Lyme disease. Once in the body's system, this disease debilitates the infected person for years. Any gardener, hiker, or nature lover who enjoys the wilderness knows the danger, as well as the inconvenience, of time lost in health from a tick bite.

Ticks are parasitic mites or acaroids of genus Ixodes that bury their head into the skin of the host to suck blood. Ticks live and breed in tall grass and wooded areas.

A single tick bite from a tick infested with Lyme disease can virtually paralyze one's immune system for over a year. A recent New York Times article, dated in the summer of 2000, reported that although millions of dollars of research have been appropriated to develop a cure for this debilitating disease, no cure is in site.

A test drug that does not cure the disease, but lessens the symptoms of Lyme disease is now being tested. Any drug, before it is FDA approved, must be clinically tested for a ten year period. Therefore, it is not likely that any drug would be available for the Lyme disease sufferer in this decade.

Symptoms of Lyme disease include rashes, dizziness, lack of appetite, loss of hair, and the most detrimental of all, loss of physical energy. With the effects of Lyme disease paralyzing ones body, the infected is left without any physical energy for up to one year or more. Jobs are lost due to this illness, and for the young, it is impossible to attend school for the entire year. For the elderly, the illness is a life threatening breaking down of the immune system, leaving the infected more susceptible to other infections.

How wonderful it would be if all nature lovers could enjoy being out of doors without the fear of contacting a debilitating disease.

Numerous innovations for leg coverings have been provided in the prior art that will be described. Even though these innovations may be suitable for the specific individual purposes to which they address, however, they differ from the present invention in that they do not teach a disposable one-time use legging for covering, and protecting, a lower leg of a wearer from, and capturing, ticks so as to allow the joy of exploring in the woods and the joy of gardening at home to be restored without the fear of the disease bite of a tick.

For example, U.S. Pat. No. 3,618,232 to Shnuriwsky teaches a boot having a relatively stiff upper terminating in a foot receiving mouth opening and a flexible tubular sleeve having one end secured about the mouth opening and movable from a retracted position embracing the boot to an extended position above the boot and a closure preferably in the form of a drawstring on the other end of the sleeve.

Another example, U.S. Pat. No. 3,758,963 to Knight teaches a snake bite preventing device comprising thigh protecting material adapted to be removably affixed to the thigh of a wearer. Leg protecting material is adapted to be removably affixed to the leg of the wearer. Foot protecting material is adapted to be removably affixed to the foot of the wearer. Flexible material is affixed to, and extends between, the thigh protecting material and the leg protecting material.

Still another example, U.S. Pat. No. 4,497,070 to Cho teaches a unitary leg and foot protective device of soft energy absorbing material which may be worn by a human comprising a lower portion for covering the top and sides of the foot of the wearer, a middle portion for covering the front and sides of the ankle of the wearer and an upper portion covering the shin of the wearer.

Yet another example, U.S. Pat. No. 5,005,215 to McIlquham teaches an article of clothing that is designed to protect a user from ticks, other arachnids, and crawling insects. The article of clothing can be in the form of a chap that encircles the leg of the user. Ties near the top of the chap support the chap on the user's belt. The chap material is sewn to create a circumferential flap, preferably near the top of the chap. An impervious strip encircles the chap, just below the flap. A narrower absorbent strip is sewn onto the impervious strip. Tick repellent may be applied to the absorption strip, and the impervious strip prevents the repellent from soaking through to the chap material and the user's clothing. The flap tends to hang downward to shield the absorbent strip. A hem at the bottom draws the chap material around the leg of the user.

Still yet another example, U.S. Pat. No. 5,381,557 to Luria et al. teaches a device serving as a barrier and trap for ticks, other arachnids, insects, and other small crawling creatures, which is to be worn around the limb of a user, i.e., the leg(s) and/or arm(s), depending on the area(s) of potential exposure. It comprises a band fitted about the limb and an adhesive surface on the band for trapping the crawling creatures, thus preventing them from gaining access to the parts of the body that are past the point on the limb where the device is fitted. The device also comprises a shield structure to protect the adhesive surface in the form of a lip member extending from one end of the band and having an integral shielding surface opposite the adhesive surface with spacing means to prevent the lip member from sticking to the adhesive surface while spacing it therefrom to permit free access of crawling creatures.

It is apparent that numerous innovations for leg coverings have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a disposable one-time use legging for covering, and protecting, a lower leg of a wearer from, and capturing, ticks that avoids the disadvantages of the prior art.

Another object of the present invention is to provide a disposable one-time use legging for covering, and protecting, a lower leg of a wearer from, and capturing, ticks that is simple and inexpensive to manufacture.

Still another object of the present invention is to provide a disposable one-time use legging for covering, and protecting, a lower leg of a wearer from, and capturing, ticks that is simple to use.

Briefly stated, yet another object of the present invention is to provide a disposable one-time use legging for covering, and protecting, a lower leg of a wearer from, and capturing, ticks. The legging includes a sleeve, first bands, and a second band. The uppermost terminal end of the sleeve is formed into an upper circumferential tunnel, and the lowermost terminal end of the sleeve is formed into a lower circumferential tunnel. The first bands include an uppermost first band that is elastic and encased in the uppermost circumferential tunnel of the sleeve for maintaining the uppermost terminal end of the sleeve in position tightly and securely around, and in direct snug contact with, the lower leg of the wearer, just below the knee of the wearer so as to prevent the ticks from getting therebetween, an intermediate first band that is elastic and encased in the lowermost circumferential tunnel of the sleeve for maintaining the lowermost terminal end of the sleeve in position tightly and securely around, and in direct snug contact with, the ankle of the wearer so as to prevent the ticks from getting therebetween, and a lowermost first band that is elastic and depends from the lowermost terminal end of the sleeve so as to form a stirrup for receiving the foot of the wearer. The second band includes a strip of adhesive that extends around the sleeve for capturing the ticks attempting to excursion thereon, and a release sheet that releasably covers the strip of adhesive thereof, prior to use.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole FIGURE of the drawing is a diagrammatic perspective view of the present invention in use.

LIST OF REFERENCE NUMERALS UTILIZED IN THE DRAWING

10 disposable one-time use legging of present invention for covering, and protecting, lower leg 12 of wearer 14 from, and capturing, ticks 16

12 lower leg of wearer 14

14 wearer

16 ticks

18 sleeve 18 for receivingly covering, and protecting, lower leg 12 of wearer 14 from ticks 16

20 first bands for maintaining sleeve 18 on lower leg 12 of wearer 14

22 second band for capturing ticks 16 attempting to excursion thereon, since ticks 16, unlike many other insects, climb and do not fly

24 uppermost terminal end of sleeve 18 for positioning around lower leg 12 of wearer 14, just below knee 26 of wearer 14

26 knee of wearer 14

28 lowermost terminal end of sleeve 18 for positioning around ankle 30 of wearer 14

30 ankle of wearer 14

32 outer surface of sleeve 18

33 intermediate area of outer surface 32 of sleeve 18

34 uppermost first band 34 of first bands 20 for maintaining uppermost terminal end 24 of sleeve 18 in position tightly and securely around, and in direct snug contact with, lower leg 12 of wearer 14, just below knee 26 of wearer 14 so as to prevent ticks 16 from getting therebetween

35 upper circumferential tunnel formed by uppermost terminal end 24 of sleeve 18

36 intermediate first band of first bands 20 for maintaining lowermost terminal end 28 of sleeve 18 in position tightly and securely around, and in direct snug contact with, ankle 30 of wearer 14 so as to prevent ticks 16 from getting therebetween

37 lower circumferential tunnel formed by lowermost terminal end 28 of sleeve 18

38 lowermost first band of first bands 20

40 stirrup of first bands 20 for receiving foot 42 of wearer 14 and further maintaining lowermost terminal end 28 of sleeve 18 in position tightly and securely around, and in direct snug contact with, ankle 30 of wearer 14 so as to prevent ticks 16 from getting therebetween

42 foot of wearer 14

44 strip of adhesive of second band 22 for capturing ticks 16 attempting to excursion thereon, since ticks 16, unlike many other insects, climb and do not fly

46 release sheet of second band 22

DETAILED DESCRIPTION OF THE PREFERRED EMBODIMENT

Referring now to the sole FIGURE, which is a diagrammatic perspective view of the present invention in use, the disposable one-time use legging of the present invention is shown generally at 10 for covering, and protecting, a lower leg 12 of a wearer 14 from, and capturing, ticks 16.

The configuration of the disposable one-time use legging 10 can best be seen in the sole FIGURE, which again is a diagrammatic perspective view of the present invention in use, and as such, will be discussed with reference thereto.

The disposable one-time use legging 10 comprises a sleeve 18 for receivingly covering, and protecting, the lower leg 12 of the wearer 14 from the ticks 16.

The disposable one-time use legging 10 further comprises first bands 20 that are attached to the sleeve 18 for maintaining the sleeve 18 on the lower leg 12 of the wearer 14.

The disposable one-time use legging 10 further comprises a second band 22 that is attached to the sleeve 18 for capturing the ticks 16 attempting to excursion thereon, since the ticks 16, unlike many other insects, climb and do not fly.

The sleeve 18 is tubular.

The sleeve 18 is made from a non-toxic bio-degradable material that is environmentally friendly and hypoallergenic.

The sleeve 18 is plastic.

The sleeve 18 is paper.

The sleeve 18 has a length, an uppermost terminal end 24 for positioning around the lower leg 12 of the wearer 14, just below the knee 26 of the wearer 14, a lowermost terminal end 28 for positioning around the ankle 30 of the wearer 14, and an outer surface 32 that extends from the uppermost terminal end 24 thereof to the lowermost terminal end 28 thereof, and which has an intermediate area 33 that is disposed intermediate the uppermost terminal end 24 thereof and the lowermost terminal end 28 thereof.

The uppermost terminal end 24 of the sleeve 18 is gathered and formed into an upper circumferential tunnel 35.

The lowermost terminal end 28 of the sleeve 18 is gathered and formed into a lower circumferential tunnel 37.

The intermediate area 33 of the outer surface 32 of the sleeve 18 is disposed from approximately one-third to approximately one-half the length of the sleeve 18 from the uppermost end 24 thereof.

The first bands 20 comprise an uppermost first band 34 that is encased in the uppermost circumferential tunnel 35 of the sleeve 18 for maintaining the uppermost terminal end 24 of the sleeve 18 in position tightly and securely around, and in direct snug contact with, the lower leg 12 of the wearer 14, just below the knee 26 of the wearer 14 so as to prevent the ticks 16 from getting therebetween.

The uppermost first band 34 is sewn in the uppermost circumferential tunnel 35 of the sleeve 18.

The uppermost first band 34 is elastic to facilitate donning of the disposable one-time use legging 10.

The first bands 20 further comprise an intermediate first band 36 that is encased in the lowermost circumferential tunnel 37 of the sleeve 18 for maintaining the lowermost terminal end 28 of the sleeve 18 in position tightly and securely around, and in direct snug contact with, the ankle 30 of the wearer 14 so as to prevent the ticks 16 from getting therebetween.

The intermediate first band 36 is sewn in the lowermost circumferential tunnel 37 of the sleeve 18.

The intermediate first band 36 is elastic to facilitate donning of the disposable one-time use legging 10.

The first bands 20 further comprise a lowermost first band 38 that depends from diametrically opposing sides of the lowermost terminal end 28 of the sleeve 18 so as to form a stirrup 40 for receiving the foot 42 of the wearer 14 and further maintaining the lowermost terminal end 28 of the sleeve 18 in position tightly and securely around, and in direct snug contact with, the ankle 30 of the wearer 14 so as to prevent the ticks 16 from getting therebetween.

The stirrup 40 is elastic to facilitate donning of the disposable one-time use legging 10.

The second band 22 comprises a strip of adhesive 44 that extends adheringly and circumferentially around the intermediate area 33 of the outer surface 32 of the sleeve 18 for capturing the ticks 16 attempting to excursion thereon, since the ticks 16, unlike many other insects, climb and do not fly.

The strip of adhesive 44 is double sided tape.

The second band 22 further comprises a release sheet 46 that releasably covers the strip of adhesive 44 thereof, prior to use.

It will be understood that each of the elements described above, or two or more together, may also find a useful application in other types of constructions differing from the types described above.

While the invention has been illustrated and described as embodied in a disposable one-time use legging for covering, and protecting, a lower leg of a wearer from, and capturing, ticks, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A disposable one-time use legging for covering, and protecting, a lower leg of a wearer from, and capturing, ticks, said legging comprising:

a) a sleeve for receivingly covering, and protecting, the lower leg of the wearer from the ticks;

b) first bands attached to said sleeve for maintaining said sleeve on the lower leg of the wearer; and c) a second band attached to said sleeve for capturing the ticks attempting to excursion thereon, since the ticks, unlike many other insects, climb and do not fly;

wherein said sleeve has:

i) a length;

ii) an uppermost terminal end for positioning around the lower leg of the wearer, just below the knee of the wearer;

iii) a lowermost terminal end for positioning around the ankle of the wearer; and iv) an outer surface that extends from said uppermost terminal end thereof to said lowermost terminal end thereof, and has an intermediate area that is disposed intermediate said uppermost terminal end thereof and said lowermost terminal end thereof;

wherein said uppermost terminal end of said sleeve is gathered and formed into an upper circumferential tunnel;

wherein said lowermost terminal end of said sleeve is gathered and formed into a lower circumferential tunnel;

wherein said first bands comprise an uppermost first band that is encased in said uppermost circumferential tunnel of said sleeve for maintaining said uppermost terminal end of said sleeve in position tightly and securely around, and in direct snug contact with, the lower leg of the wearer, just below the knee of the wearer so as to prevent the ticks from getting therebetween;

wherein said uppermost first band is sewn in said uppermost circumferential tunnel of said sleeve;

wherein said first bands further comprise an intermediate first band that is encased in said lowermost circumferential tunnel of said sleeve for maintaining said lowermost terminal end of said sleeve in position tightly and securely around, and in direct snug contact with, the ankle of the wearer so as to prevent the ticks from getting therebetween;

wherein said intermediate first band is sewn in said lowermost circumferential tunnel of said sleeve; and wherein said first bands further comprise a lowermost first band that depends from diametrically opposing sides of said lowermost terminal end of said sleeve so as to form a stirrup for receiving the foot of the wearer and further maintaining said lowermost terminal end of said sleeve in position tightly and securely around, and in direct snug contact with, the ankle of the wearer so as to prevent the ticks from getting therebetween.

2. The legging as defined in claim 1, wherein said sleeve is tubular.

3. The legging as defined in claim 1, wherein said sleeve is made from a non-toxic bio-degradable material that is environmentally friendly and hypoallergenic.

4. The legging as defined in claim 1, wherein said sleeve is plastic.

5. The legging as defined in claim 1, wherein said sleeve is paper.

6. The legging as defined in claim 1, wherein said intermediate area of said outer surface of said sleeve is disposed from approximately one-third to approximately one-half said length of said sleeve from said uppermost end thereof.

7. The legging as defined in claim 1, wherein said uppermost first band is elastic to facilitate donning of said disposable one-time use legging.

8. The legging as defined in claim 1, wherein said intermediate first band is elastic to facilitate donning of said disposable one-time use legging.

9. The legging as defined in claim 1, wherein said stirrup is elastic to facilitate donning of said disposable one-time use legging.

10. The legging as defined in claim 1, wherein said second band comprises a strip of adhesive that extends adheringly and circumferentially around said intermediate area of said outer surface of said sleeve for capturing the ticks attempting to excursion thereon, since the ticks, unlike many other insects, climb and do not fly.

11. The legging as defined in claim 10, wherein said strip of adhesive is double sided tape.

12. The legging as defined in claim 10, wherein said second band further comprises a release sheet that releasably covers said strip of adhesive thereof, prior to use.

* * * * *